United States Patent [19]

Norris

[11] 4,151,062

[45] Apr. 24, 1979

[54] METALS RECOVERY APPARATUS

[76] Inventor: Richard J. Norris, 3801 Lakeview Ter., Falls Church, Va. 22041

[21] Appl. No.: 866,919

[22] Filed: Jan. 4, 1978

[51] Int. Cl.[2] ..... C25C 7/00

[52] U.S. Cl. ..... 204/273; 204/275

[58] Field of Search ..... 204/273, 275, 234, 237

[56] References Cited

U.S. PATENT DOCUMENTS

| | | | |
|---|---|---|---|
| 1,937,179 | 11/1933 | Weisberg et al. | 204/273 |
| 2,073,664 | 3/1937 | Weisberg et al. | 204/273 |
| 3,558,455 | 1/1971 | Sorensen et al. | 204/273 |
| 3,558,466 | 1/1971 | Lebrizzi et al. | 204/275 |
| 3,964,990 | 6/1976 | Woyden | 204/275 |
| 3,966,567 | 6/1976 | Pace et al. | 204/275 |

*Primary Examiner*—R. L. Andrews
*Attorney, Agent, or Firm*—Eric P. Schellin

[57] ABSTRACT

A metals recovery apparatus and process for use with an electroplating system acting to remove metals from a used plating solution. The present apparatus includes a plating tank and a pair of electrode plates in spaced parallel relationship. There is a plating solution circulating system in the plating tank for moving the solution between the electrodes in a swirling motion and for adding a controlled amount of additional solution. The circulating system is provided with directional nozzles to cause the swirling motion of the plating solution, which provides a more uniformly distributed plating pattern on the cathode plate.

9 Claims, 7 Drawing Figures

METALS RECOVERY APPARATUS

BACKGROUND OF THE INVENTION

The present invention relates to a metals recovery apparatus and process for recovering valuable metals from a used electroplating solution and, more particularly, to a metals recovery apparatus where additional plating solution is added at a controlled rate and directional nozzles dictate the plating pattern.

A lot of the electroplating done in this country is done by speciality companies such as electronics manufacturers, eyeglass frame manufacturers, watch makers and similar type industries. In order to cut costs it is a common practice among these speciality companies to recover as much of the valuable metals from used plating solutions as possible. Frequently, the used plating solutions are shipped out of the country to a foreign company for processing since the domestic companies dealing in metals recovery are usually very expensive and their processing has a high turn-around time. The problems of dealing with foreign companies are that shipping costs make the total cost expensive and the turn-around time sometimes runs into several weeks or months. Many of the speciality companies have had to choose between dealing with a high cost and sometimes inefficient domestic company or a foreign company which has a high turn-around time. Some companies have attempted to adapt existing apparatus to their purposes, however, this has only met with limited success. Until the present invention there has not been an inexpensive efficient metals recovery unit which meets the needs of the speciality items industry.

It is well known that electroplating processes can be better carried out at high speeds in agitated plating baths than in non-agitated baths and that vigorously agitated solutions act faster than gently agitated solutions. The reason for such faster rate of deposition is that the turbulence set up within the solution insures constant replacement with fresh solution of the film of electrolyte over the cathode.

It is also known that electroplating processes can be carried out with recirculation of the plating solution between a plating tank and a holding tank. The purpose of the recirculation of the solution is usually to remove metal sediments and the like.

Until the present invention it has not been suggested to vigorously agitate a plating solution between a pair of parallel electrodes in a predetermined pattern and at the same time constantly add untreated plating solution at a controlled rate.

Prior art patents which show agitation of the plating solution and re-circulation of the solution are well known, for example, U.S. Pat. No. 1,431,022, issued to Mumford, discloses such a plating system. In Mumford an electrolytic plating solution is re-circulated between a plating tank and a holding tank, and the solution is agitated between the electrode plates.

In U.S. Pat. No. 2,046,467, issued to Krause, a liquid sterilization apparatus and process is disclosed where an untreated liquid is mixed with a portion of the treated liquid to control the degree of treatment. A liquid to be treated is sprayed against parallel plate electrodes where an oligodynamically active metal is supplied to the liquid by an electric current.

Other prior art patents which show agitation of the plating solution between the electrodes include U.S. Pat. Nos. 3,503,856, Blackmore, and 4,028,272, Bowen et al. The electroposition process of Blackmore discloses a plating tank with spaced electrodes and apertured pipework between the electrodes to direct a jet of electrolyte solution upon the cathodes. It is suggested in Blackmore that better electroplating is achieved by controlling the solution flow rate, aperture size, spacing and distance from the cathode. However, the Blackmore patent like other prior patents does not disclose an inventive process for controlling the solution flow.

The prior art patents in fact are directed to electroplating solution circulating systems which are of general interest to the present invention but do not suggest the present apparatus and process for recovering metals from used plating solutions. It is therefore the purpose of this invention to provide an apparatus and process for recovering metals from electroplating solutions which includes an improved solution recirculation system for controlling the mixing of an untreated solution with a treated solution, and to provide an efficient nozzle arrangement which agitates the solution in a described pattern between a pair of electrodes.

SUMMARY OF THE INVENTION

It is a primary object of this invention to provide a metals recovery apparatus and process which has a high rate of recovery.

It is an additional object of this invention to provide a metals recovery apparatus and process which has a controlled mixing ratio between treated and untreated plating solutions.

It is a further object of this invention to provide a metals recovery apparatus with an improved nozzle arrangement for describing an agitation pattern for the plating solution.

Still another object of this invention is to provide a metals recovery apparatus of improved construction and design.

Another object of this invention is to provide a metals recovery process for recovering valuable metals from solution in short periods of time.

Another object of this invention is to provide a compact metals recovery apparatus that is simple to operate.

According to the invention, there is provided a casing which contains a plating tank and a constant flow re-circulating pump. The pump is connected to a used electroplating solution drag-out tank to pump the solution to the plating tank. The outlet side of the pump is connected to circulating tubing in the plating tank which has nozzles arranged to move the solution in a circular pattern. A pair of electrode plates are positioned on either side of the circulating tubing and parallel to one another to attract the metals in solution.

The process for recovering metals from a plating solution includes the steps of circulating the plating solution from the drag-out tank to the plating tank and returning part of the treated solution to the drag-out tank. The untreated solution circulated to the plating tank is mixed at a predetermined ratio with treated plating solution recycled from the plating tank. By keeping the ratio of untreated solution to treated solution fixed, the amount of metal plated out of the solution on the cathode can be maintained at an optimum. This is particularly true where the untreated solution is pumped at a constant flow rate and the treated solution is pumped at a flow rate which is calculated for each metal thereby providing the proper amount of metal in solution in the plating tank at all times. The amount of treated solution passing through the constant flow pump is regulated by a valve where the flow from the plating tank can be shut off, partially restricted, or fully opened.

DESCRIPTION OF THE DRAWINGS

Other objects and advantages of this invention will become apparent from the following detailed description thereof and the accompanying drawings wherein.

DESCRIPTION OF THE PREFERRED EMBODIMENT

Figure 1:
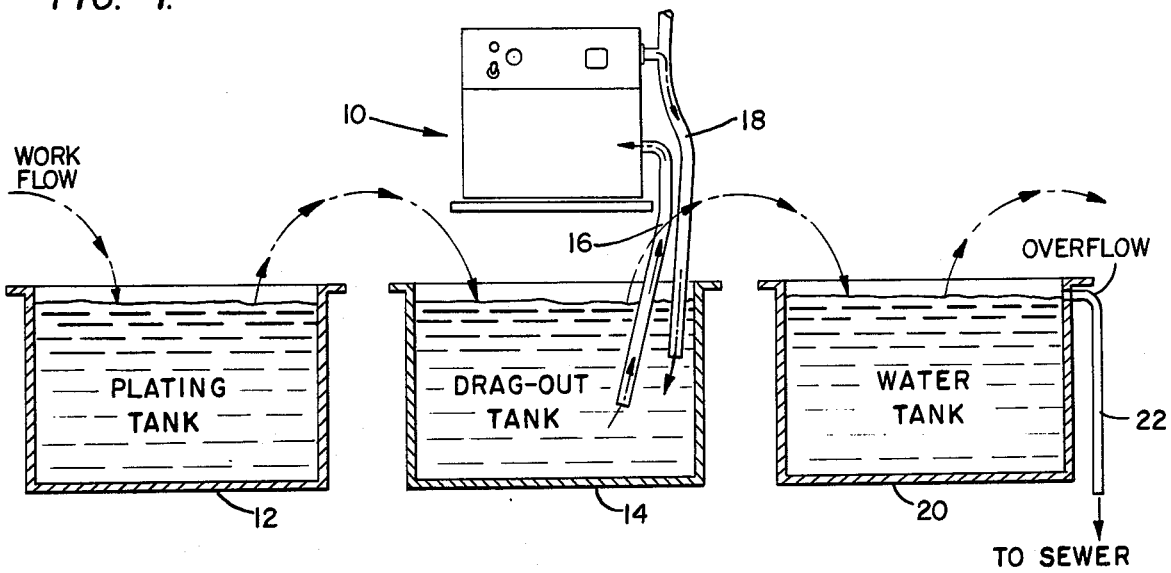
FIG. 1 shows the metals recovery apparatus of this invention in use with an electroplating system.

Referring to the drawings, and in particular to FIG. 1, there is shown a metals recovery apparatus 10 of this invention and an electroplating system tank 12. Articles such as electronic components, eyeglass frames and watches are electroplated in tank 12. Used electroplating solution is removed from tank 12 and emptied into a drag-out tank 14. In the past, the solution in drag-out tank 14 would be bottled and shipped to a metals recovery company for processing, however, with the metals recovery apparatus 10 of this invention the valuable metals can be recovered as a continuous process step of the electroplating process. The used electroplating solution is pumped from the drag-out tank 14 to the metals recovery apparatus through inlet tubing 16. After the solution has been treated to remove the valuable metals a portion of the treated solution is returned to the drag-out tank through overflow tubing 18 to eventually overflow into a dilute solution water tank 20 for disposal through overflow tubing 22.

Figure 2:
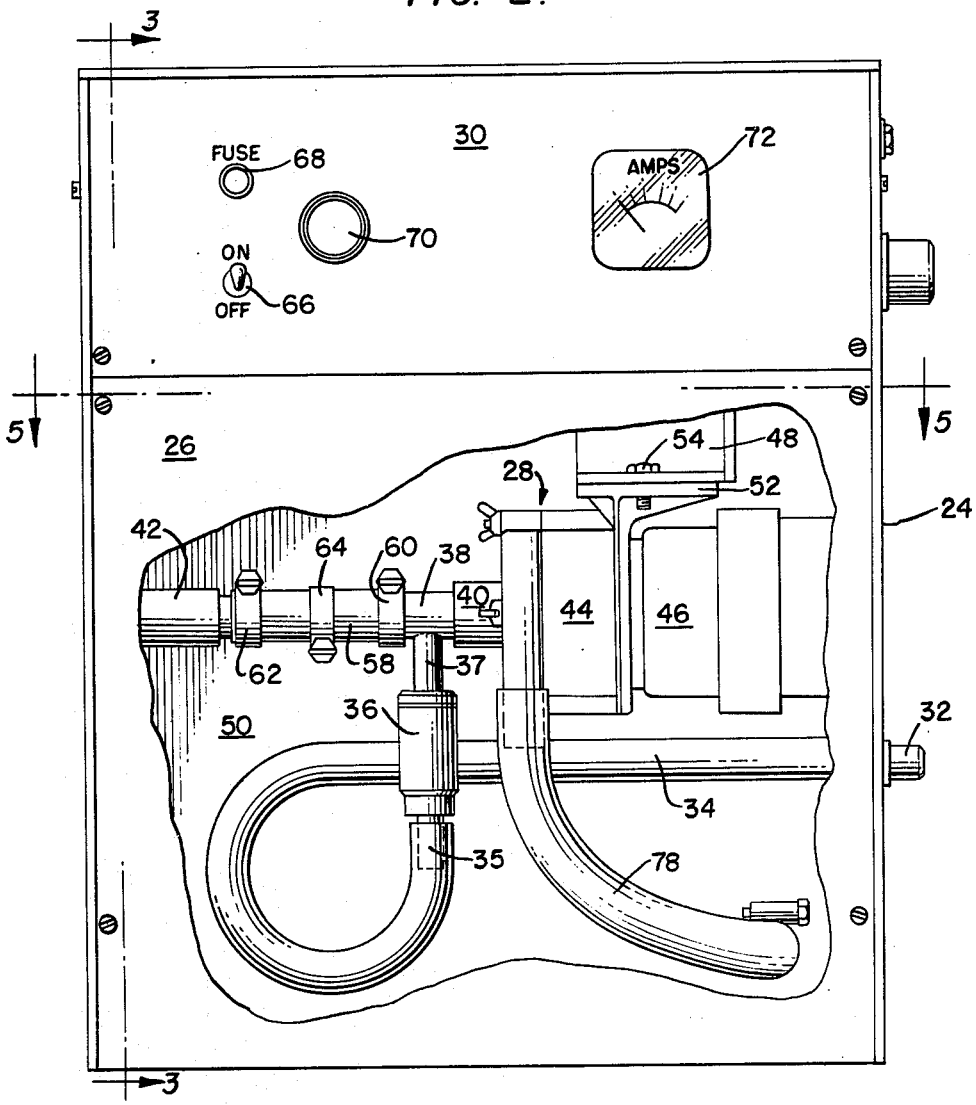
FIG. 2 is a side elevation partly in section of the metals recovery apparatus of this invention.

In FIG. 2 the metals recovery apparatus 10 is shown with a housing 24, a lower front cover plate 26 covering a constant flow circulating pump 28, and an upper electric components support panel 30. Mounted on the side of the housing 24 is a plastic nipple 32 which is connected to the inlet tubing 16. The other end of the plastic nipple 32, not shown, is connected to a lead-in tubing 34 which connects to the inlet side 35 of a check valve 36. The lead-in tubing 36 will usually be fixed to the check valve 36 by a pinch clamp, which has been left off to more clearly show the connection. Check valve 36 is a conventional valve arrangement which controls the back flow of a liquid; therefore, there are many such valves which can be used with this invention. The outlet side 37 of check valve 36 connects to a T-fitting 38. One end of the T-fitting 38 is connected to the inlet 40 of pump 28, and the free end of the fitting is connected to a return tubing 42 which will be discussed in detail later. The constant flow circulating pump assembly 28 includes a pump 44 and a motor 46. A bracket support 48 is fixed to an interior dividing wall 50 to support the motor assembly 28. There is a bracket device 52 on the pump assembly 28 which is attached to bracket support 48 by a pair of bolts 54 and 56.

In between the return tubing line 42 and the T-fitting 38 there is a rubber hose connection 58 with pinch clamps 60 and 62. The rubber hose connection 58 is sufficiently flexible to allow the hose opening to be restricted by a pinch valve 64. There are situations where proper mixing of a treated solution with an untreated solution can be better controlled by restricting the return flow through tubing line 42, hence the pinch valve 64 has been included in return tubing line 42.

Electrical support panel 30 includes an off-on switch 66, a fuse holder 68, a rheostat control knob 70 and an ampere meter 72. Mounted in the housing 24 adjacent to panel 30 is a rheostat which controls the amount of D.C. amperes output, a transformer and other electrical components, such as diodes, and circuits for controlling the electrical current flow.

Figure 4:
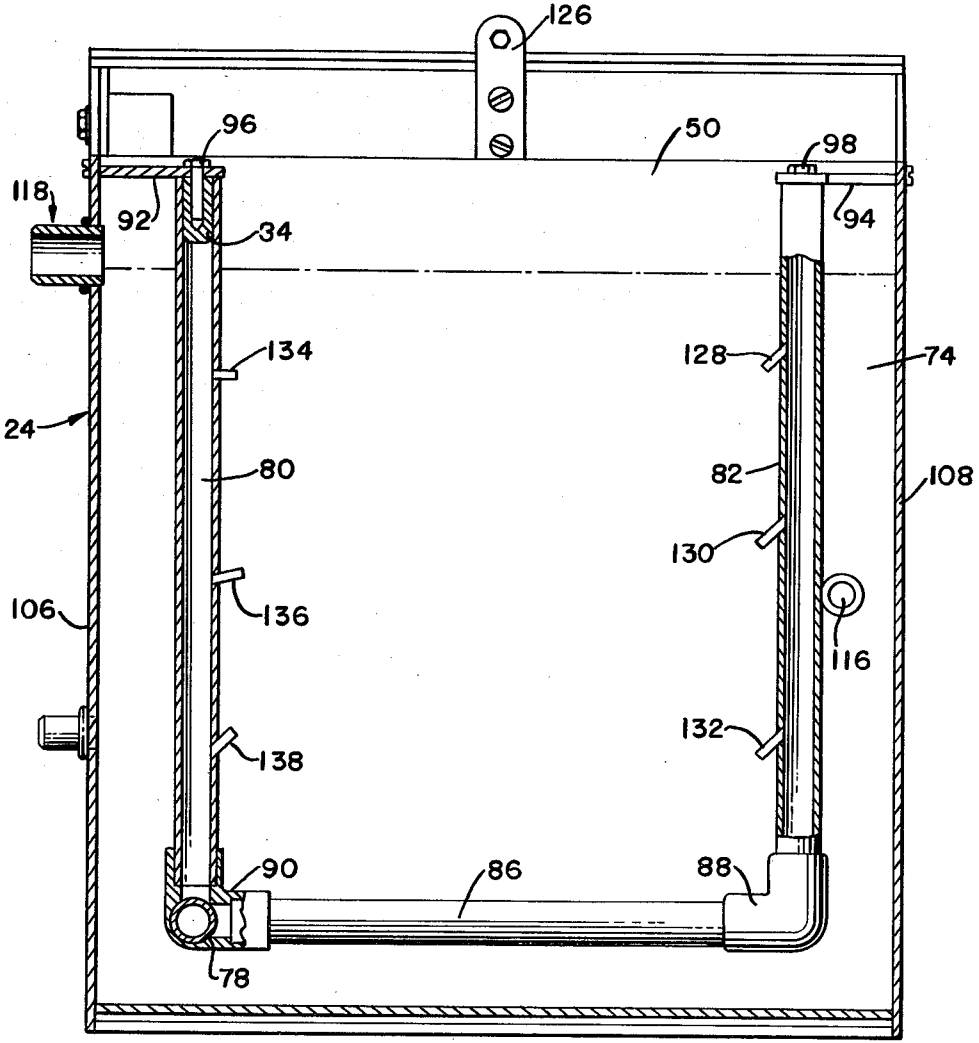
FIG. 4 is a cross-sectional view of the metals recovery apparatus of this invention taken along the line 4—4 of FIG. 3.
Figure 3:
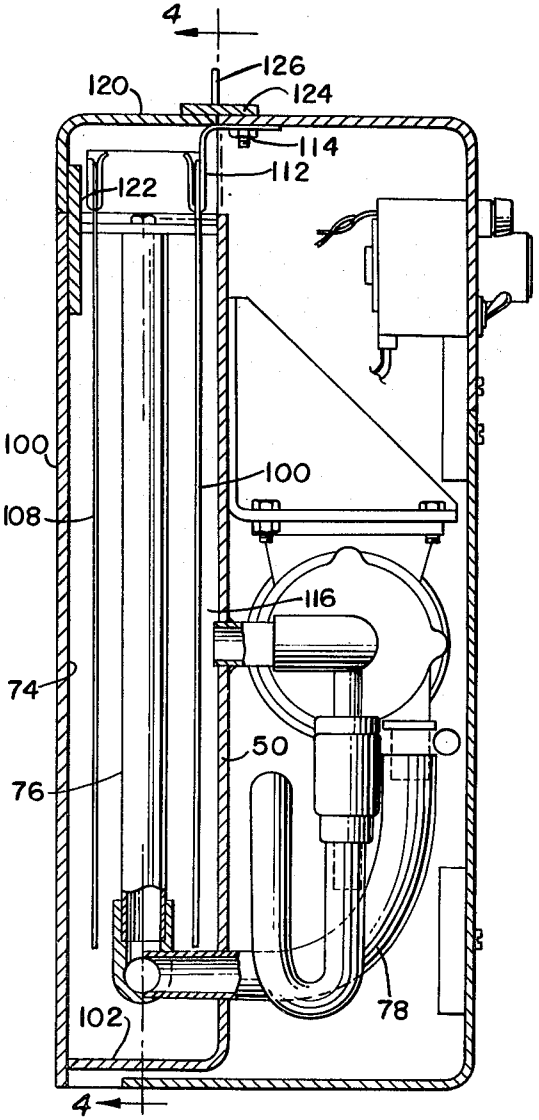
FIG. 3 is a sectional end view of the metals recovery apparatus of this invention taken along the line 3—3 of FIG. 2.
Figure 5:
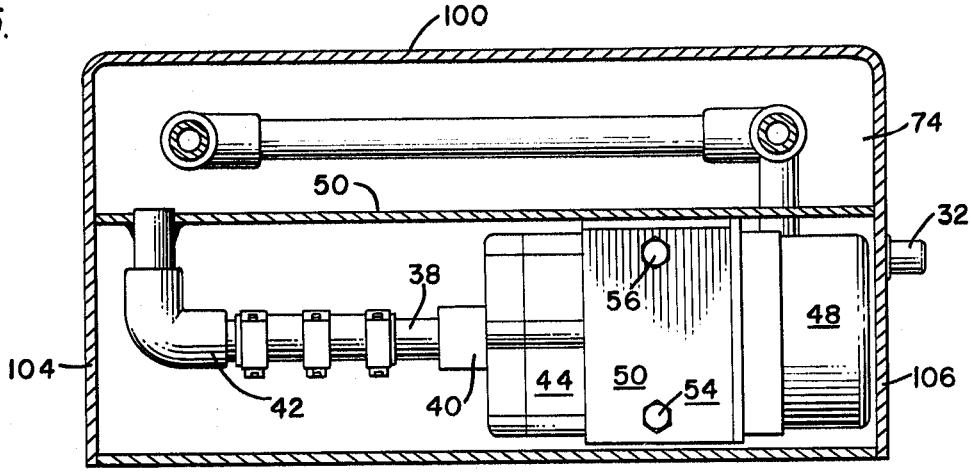
FIG. 5 is a top cross-sectional view of the metals recovery apparatus of this invention taken along the line 5—5 of FIG. 2.

Interior wall 50 separates the metals recovery apparatus 10 into two compartments; the first holds the constant flow circulating pump assembly 28 and associated tubing, and the second compartment forms a plating tank 74 as shown in FIGS. 3, 4 and 5. Turning to FIG. 3, there is a plating solution circulating tubing 76 connected to the outlet tubing 78 from constant flow circulating pump assembly 28. The plating solution circulating tubing 76 has a pair of vertical tubes 80 and 82 sealed at their upper ends by plugs 84 and connected at their lower ends to a cross tubing 86 by elbow connectors 88 and 90. The outlet tubing 78 is tapped into the circulating tubing 76 in the side of elbow connector 90. A pair of support brackets 92 and 94 mounted to housing 24 are connected to the plugs 84 by bolts 96 and 98. The brackets 92 and 94 support the circulating tubing 76 equally spaced between the interior wall 50 and outside wall 100. The interior wall 50 has an L-shaped lower end 102 which is welded to outside wall 100 and to side walls 104 and 106 of the housing 24, as shown in FIG. 5.

The vertical tubes 80 and 82 have inwardly facing nozzles 128, 130, 132, 134, 136 and 138, respectively. The nozzles are arranged to create a swirling or agitating motion of the solution between the plate electrodes 108 and 110. In other words, nozzles 128, 130 and 132 are directed downwardly and nozzles 134, 136 and 138 are either directed upwardly or, as in the case of nozzle 134, directed horizontally across the tank. While the downwardly and upwardly directed nozzles may work at a wide range of angles, it has been found through experimentation that by having the nozzles at a slightly different angle better circulation of the solution can be achieved. The preferred angle for each of the nozzles which works well with the constant flow circulation pump assembly 28 is where nozzles 128, 130 and 132 are angled downwardly at an angle of about 45 degrees, and the opposite top nozzle 134 is directed horizontally at an angle of about 90 degrees, middle nozzle 136 is angled upwardly at an angle of about 10 degrees and bottom nozzle 138 is angled upwardly at an angle of about 45 degrees. It should be understood that good plating can be had by using more or less nozzles and that the nozzles may be arranged at various angles without departing from the invention.

Supported in the plating tank 74 are two plate electrodes 108 and 110. These plate electrodes 108 and 110 are supported by an insulated bracket 112 that is mounted to the top portion of panel 30 by fastener 114. There are electrical leads connecting the electrodes 108 and 110 to the electrical circuitry contained within the housing 24. One of the electrodes forms the cathode for collecting metals and the other the anode for collecting non-metals. The electrodes 108 and 110 are positioned in the plating tank 74 on either side of the plating solution circulating tubing 76 and in a parallel spaced relationship to one another.

The return tubing line 42 is welded to an orifice 116 on the interior wall 50 as shown in FIGS. 3 and 4 to constantly remove a portion of the treated plating solution from the plating tank for recycling. The orifice 116 is positioned about one-half the distance between the top and bottom of the wall 50.

There is shown in FIG. 4 an overflow outlet 118 in side wall 106 for removing excess treated plating solution from the plating tank 74. The overflow outlet is connected to the overflow tubing 18 which empties into drag-out tank 14.

The metals recovery appatatus 10 is completed by a plating tank cover 120 which is L-shaped and includes a locking means. The cover 120 has an interior flat element 122 which engages the inside surface of wall 100 and an outside flat element 124 which engages the outside top surface of panel 30. The outside element 124 has a slot, not shown, for receiving a hasp 126 affixed to interior wall 50. The hasp has a hole 128 for a lock, not shown, to prevent removal of the cover 120 from the apparatus 10.

The constant flow circulating pump assembly 28 pumps about 550 gallons per hour, and the plate electrodes which are stainless steel plates with a surface area of about one foot square receive about two or more amps of current.

The metals recovery housing and other non-conductive parts may be made of chemical resistant plastic or rubber material.

In operation the constant flow circulating pump assembly 28 draws electroplating solution from the drag-out tank 14 through inlet tubing 16 and feeds it through outlet tubing 78 through circulating tubing 76 and out outlet nozzles. The electroplating solution emerges under pressure through the nozzles into the body of the solution in plating tank 74 as a series of streams or jets between the plate electrodes 108 and 110. The rate at which the solution is pumped into the nozzles, the diameter and number of nozzles and the distance between the circulating tubing and the plate electrodes 108 and 110 should be so provided that electroplating can be effected rapidly on the cathode whilst avoiding adverse effects on the structure of the deposited layer through too vigorous impingement of the solution on the plate electrodes.

The invention is further illustrated in the examples below using the following testing procedures where the pumping rates were checked with different openings of the pinch valve. The results of these preliminary tests are as follows:

| | Pinch Valve Position | Circulation From Drag-Out Tank |
|---|---|---|
| Test A | Pinch valve open | No flow rate from the outside tank circulated into the unit |
| Test B | Pinch valve partially closed | Flow rate to and from outside tank = 2.85 liters/min. |
| Test C | Pinch valve closed | Flow rate to and from outside tank = 4.0 |

-continued

| | Pinch Valve Position | Circulation From Drag-Out Tank |
|---|---|---|
| | | liters/min. |

For these tests the top level of the drag-out tank was five inches below the bottom of the apparatus, and the pump was rated at 9.17 gallons per minute (550 gal./hr.). Before running the electroplating solutions experiments a preliminary test using an acid copper solution was performed to get the "feel" of the unit and to judge such conditions as allowable current densities, deposit patterns, etc. No data was accumulated from this preliminary test other than the apparatus plated well with a good deposit. A total of two amps of current was used with a cathode area of one square foot (2 A.S.F.).

SILVER-PLATING SOLUTION EXPERIMENTS

Fourteen liters of fresh silver-plating solution were prepared to contain approximately what would be found in the drag-out water from a standard silver cyanide plating solution. It contained the following:

Silver = 0.04 Troy oz./gal.
Potassium cyanide = 0.12 oz./gal.
Potassium carbonate = 0.02 oz./gal.

The metals recovery apparatus holds 12 liters and the drag-out tank (simulated drag-out tank) held the other 2 liters. The apparatus was turned on with the cathode removed so that the solution could circulate through the unit. Once the cathode was put in place it was noted that the total amperes available was less than 0.5 amps. It was finally deduced that the conductivity of the solution was too low, so an additional 0.88 oz./gal. of potassium cyanide was introduced to the plating solution. This made a total of 1.0 oz./gal. This amount was enough to allow the unit to reach a total current of over 3 amps. (In practical application this additional amount will not be necessary because of the build up of cyanide in the rinse tank. On new installations a small addition may be needed to reach the desired ampere reading of 2 or more.)

Once the unit was put under test it was also noted that the initial deposition took some time to occur, even with the stainless steel cathode cleaned and "activated". The cathode was then copper-plated (flash) and an additional test was started. The copper flash allowed the silver to begin depositing a uniform deposit at the beginning of the test.

Three experiments were run with the silver solution; all three were under identical conditions except for the flow rates as noted above.

Preliminary data

With a metal concentration of 0.04 oz./gal. the total content is 4.6 grams. At 100% cathode eff. the total time required to deposit this amount is 68.58 amp min. A total surface area of one square foot was used, a total current of 2 amps and the current density was 2 A.S.F.

RESULTS OF THE SILVER EXPERIMENTS

| | Time | Actual Weight | Theoretical Weight |
|---|---|---|---|
| Experiment C | after 10 min. | 1.28 grams | 1.30 grams |
| (Valve Open) | after 20 min. | 2.58 grams | 2.60 grams |
| | after 30 min. | 3.88 grams | 3.90 grams |

-continued

RESULTS OF THE SILVER EXPERIMENTS

| | Time | Actual Weight | Theoretical Weight |
|---|---|---|---|
| | after 35 min. | 4.53 grams | 4.60 grams |
| Eff. = 98.5% | | | |
| Experiment B | after 10 min. | 1.27 grams | 1.30 grams |
| (Valve Partially Open) | after 20 min. | 2.55 grams | 2.60 grams |
| | after 30 min. | 3.83 grams | 3.90 grams |
| | after 35 min. | 4.54 grams | 4.60 grams |
| Eff. = 98.7% | | | |
| Experiment A | after 10 min. | 1.12 grams | 1.13 grams |
| (Valve Closed) | after 20 min. | 2.23 grams | 2.26 grams |
| | after 30 min. | 3.34 grams | 3.39 grams |
| | after 35 min. | 3.90 grams | 3.94 grams |
| Eff. = 99% | | | |

Note: In Experiment A only 12 liters were being circulated.

Figure 6:
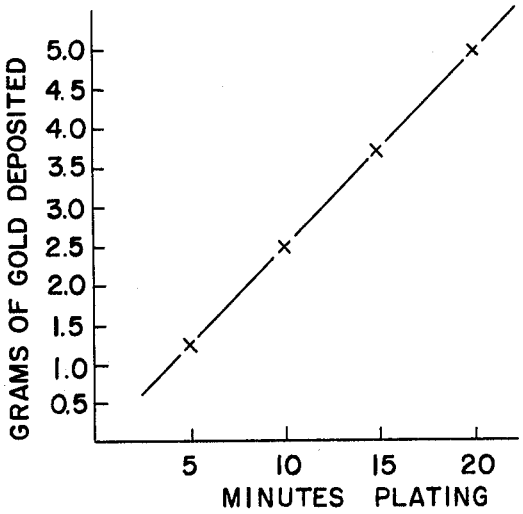
FIG. 6 is a graph showing the results of test data in recovering gold from a plating solution.

The results of these experiments show that the entire cathode was uniformly plated and that its weight was much greater than the weight of the deposit. It was, therefore, decided that a more accurate means of determining the deposit weight would be to measure the loss in metal concentration in the plating solution. So all figures are based on metal concentrations in the plating solution rather than on actual deposit weights. FIG. 6 shows the results of these experiments in grams of silver deposited versus minutes of plating time. It can be seen that there is a predictable straight line graph between grams of deposit and time.

A similar experiment was conducted on a gold solution with the pinch valve partially open.

A test solution containing 14 liters of fresh gold-plating solution was prepared to contain the following:

Gold = 0.04 Troy oz./gal.
Potassium cyanide = 1.0 oz./gal.
Potassium phosphate = 0.10 oz./gal.
Potassium carbonate = 0.10 oz./gal.

As before a current density of 2 A.S.F. was used. And since the total weight of the gold was 4.6 grams the time required to deposit this amount was 18.76 min. or 37.52 amp min. (100% eff.).

RESULTS OF THE GOLD EXPERIMENT

| Time | Actual Weight | Theoretical Weight |
|---|---|---|
| after 5 min. | 1.222 grams | 1.226 grams |
| after 10 min. | 2.448 grams | 2.452 grams |
| after 15 min. | 3.674 grams | 3.678 grams |
| after 19 min. | 4.596 grams | 4.600 grams |

Eff. = 99+%

Figure 7:
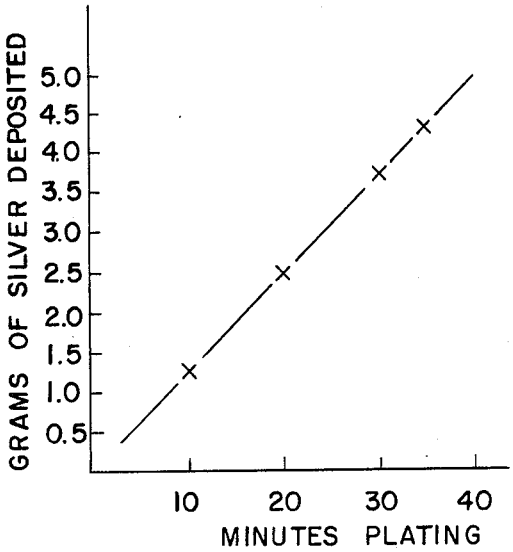
FIG. 7 is a graph showing the results of test data in recovering silver from a plating solution.

FIG. 7 shows the results of this experiment, where a straight line graph depicts the grams of gold deposited versus minutes of plating time.

From the above experiments it has been determined that the apparatus performs well and is easy to operate. It is expected that under normal operating conditions a copper flash would not be required for initial start up since the metal does eventually start to plate on the stainless steel cathode. It is also expected that a current density of 2–4 A.S.F. will result in good fine-grained deposits, with a solution at room temperature.

With the pinch valve wide open the maximum flow rate into the apparatus is about one gallon per min. With drag-out tanks larger than 60 gallons this rate may have an effect on the overall efficiency when the metal concentrations are low. However, the apparatus when used at a current density of only 2 A.S.F. is capable of depositing 11.35 Troy ounces per 8 hour day of gold or 6.21 Troy ounces of silver.

Although only one embodiment of the metals recovery apparatus and process has been described and illustrated in the drawings, it will be understood that various modifications and changes may be made by those skilled in the art without departing from the inventive concept. Reference should therefore be had to the appended claims for a definition of the scope of the invention.

What is claimed is:

1. A metals recovery apparatus comprising a housing having an interior divider wall, dividing the housing into a plating tank compartment and a pump compartment;

a pump-motor assembly in the pump compartment having a first electroplating solution inlet tubing connection and a second electroplating solution inlet tubing connection and an outlet tubing line connection for a first electroplating solution and a second electroplating solution;

means for controlling the mixing of a first electroplating solution and a second electroplating solution, located in the second electroplating solution inlet tubing;

an electroplating solution circulating means supported in the plating tank and connected to an outlet tubing line of the pump, where the circulating means includes opposited nozzle means for agitating the mixed first and second electroplating solutions in a prescribed swirling pattern;

a pair of spaced electrode means supported in the plating tank where the electrodes are positioned with the circulating means between the electrodes;

an overflow outlet in the plating tank for removing excess amounts of the first electroplating solution; and an electrical circuit means in the pump compartment connected to the spaced electrode means for passing a controlled amount of D.C. current through the electrode means.

2. The apparatus claimed in claim 1 wherein the means for controlling the mixing of the first electroplating solution and the second electroplating solution is a valve means located in the second electroplating inlet tubing line.

3. The apparatus claimed in claim 2 wherein the first electroplating inlet tubing line and the second electroplating inlet connection join to form a common inlet to the pump.

4. The apparatus claimed in claim 3 wherein a valve means is located in the first electroplating solution inlet tubing to prevent back flow in the tubing.

5. The apparatus claimed in claim 4 wherein the pair of electrode means includes plate electrodes.

6. The apparatus claimed in claim 5 wherein the second electroplating solution inlet tubing connection in the plating tank is above the outlet tubing line connection in the plating tank.

7. The apparatus claimed in claim 6 wherein the opposited nozzle means include a first set of nozzle means directed at downwardly inclined angles and a second set of nozzle means facing said first set of nozzle means where at least some of the second set of nozzle means are inclined upwardly.

8. The apparatus claimed in claim 7 wherein the first set of nozzle means is at a downwardly inclined angle of about 45 degrees.

9. The apparatus claimed in claim 8 wherein the second set of nozzle means includes at least a lower nozzle means being at an upwardly inclined angle of about 45 degrees, and a middle nozzle means being at an upwardly inclined angle of about 10 degrees.

* * * * *